US006159552A

United States Patent [19]

Riman et al.

[11] Patent Number: 6,159,552

[45] Date of Patent: Dec. 12, 2000

[54] INORGANIC CONVERSION COATINGS FOR FERROUS SUBSTRATE

[75] Inventors: Richard E. Riman, Belle Mead; Seung-Beom Cho, Highland Park, both of N.J.

[73] Assignee: Rutgers, The State University, New Brunswick, N.J.

[21] Appl. No.: 09/231,891

[22] Filed: Jan. 14, 1999

[51] Int. Cl.[7] ..... B05D 1/18

[52] U.S. Cl. ..... 427/436; 427/430.1; 427/435

[58] Field of Search ..... 427/430.1, 435, 427/436

[56] References Cited

U.S. PATENT DOCUMENTS

| | | | |
|---|---|---|---|
| 3,565,675 | 2/1971 | Sams et al. . | |
| 4,645,790 | 2/1987 | Frey et al. | 524/442 |
| 5,057,286 | 10/1991 | Chiba et al. . | |
| 5,938,976 | 8/1999 | Heimann et al. | 252/389.62 |

FOREIGN PATENT DOCUMENTS 5-125553 5/1993 Japan .

OTHER PUBLICATIONS

Rossetti et al., "Kinetics of the hydrothermal crystallization of the perovskite lead titanate," *Journal of Crystal Growth,* 116, 251–259 (1992) ( no month).

Eckert et al., "Kinetics and Mechanisms of Hydrothermal Synthesis of Barium Titanate," *Journal of the American Ceramic Society,* 79(11), 2929–2939 (1996) (no month).

Bailey, "The Stability of Acmite in the Presence of $H_2O$," *American Journal of Science,* 267, 1–16 (1969) (no month).

Laine et al., "Synthesis of pentacoordinate silicon complexes from $SiO_2$," *Nature,* 353, 642–644 (1991) (no month).

Daniels, et al., Formation and Prevention of Iron–Silicate Scales in Steam Generators, Cymric Field, California, *Proc SPE Int. Symp. Oilfield Chem*; 609 (1997) (No Month).

*Primary Examiner*—Shrive Beck
*Assistant Examiner*—Jennifer Calcagni
*Attorney, Agent, or Firm*—Synnestvedt & Lechner LLP

[57] ABSTRACT

The formation of passivation coatings on ferrous substrates is disclosed by heating the substrate in an aqueous 1.0 to 6.0 M basic metal hydroxide treatment bath containing $SiO_2$ and a water-soluble glycol, at a temperature that is effective to form a passivation coating on the substrate until the passivation coating is formed thereon, wherein the treatment bath contains from about 0.25 to about 1.0 moles of $SiO_2$ per liter of glycol and water.

20 Claims, No Drawings

INORGANIC CONVERSION COATINGS FOR FERROUS SUBSTRATE

BACKGROUND OF THE INVENTION

The present invention relates to low temperature processes for forming corrosion-inhibiting ceramic passivation coatings on ferrous substrates. In particular, the invention relates to forming passivation coatings at low temperatures using an aqueous basic metal hydroxide treatment bath containing $SiO_2$ and a water-soluble glycol.

Coatings that provide a passivating barrier of exceedingly low solubility between a metal and its environment, through conversion of the metal surface into a corrosion-resistant, nonreactive form, play an important role in coating technology. Chemical conversion coatings are formed by a chemical oxidation-reduction reaction of the surface of a metal with a suitable chemical solution. This is in contrast to paints and most metallic coatings that require no chemical reaction with the base metal. Conversion coatings find wide-spread applications because they are particularly useful as primer coatings for paints, enamels and lacquers.

Other applications for conversion coatings depend on the natural color and protective value of the coating. Conversion coatings are often absorbent, providing an ideal base for protective oils, waxes or dyes. Conversion coatings are applied to iron and steel to provide a base for organic coatings, to aid in cold forming, to improve wear resistance, or to impart color and a degree of corrosion protection to the surface.

Conversion coatings can also be used as the protective coating of brake rotors and high-temperature broilers, and for other high-temperature applications. Corrosion-resistant coatings for brake rotors and boiler inner walls must also have properties such as hardness, abrasion resistance, adhesion and thermal stability. Chromate and phosphate conversion coatings have poor abrasion resistance and thermal stability. Even low temperature heating is deleterious to most chromate and phosphate coatings because protective qualities are lost with the loss of water. It has been observed that zinc phosphate coatings heated in the absence of air lose their corrosion resistance at between 150° and 163° C. In the case of chromate coatings, temperatures above 65° C. in anhydrous environments should be avoided. Chromate and phosphate conversion coatings are also undesirable because the chemical agents used for their preparation include the highly toxic hydrazine, and the coating process pollutes the environment with chromate and phosphate ions.

Oxide coatings have good abrasion resistance and thermal stability. The process does not involve hydrogen embrittlement, so stressed parts can be treated. The small dimensional change resulting from the oxidation permits the treatment of precision parts.

Oxide coatings on ferrous substrates can be prepared by controlled high-temperature oxidation in air or by immersion in hot concentrated alkali solutions containing persulfates, nitrates or chlorates. Such coatings consist mostly of magnetite and do not protect against corrosion. Because oxide films are less porous than phosphate and chromate films, oxide films serve as a suitable base for oil, wax or paint coatings, with which some corrosion protection is obtained.

Surface conversion treatments include chemical conversion treatments obtained by dipping, spraying, brushing or swabbing without the use of external current, and anodic conversion obtained by processes in which the workpiece being treated functions as the anode in an electrolytic reaction. The coatings formed by these methods utilize phosphates, chromates, oxides, or combinations thereof, under carefully controlled conditions.

Most commonly, phosphate hydroxide coatings are formed on steel, which is referred to as Parkerizing or Bonderizing. The coatings are produced by brushing or spraying a cold or hot dilute manganese or zinc acid orthophosphate solution onto a clean surface of steel. This step removes the hydrogen developed on the surface of the coating so that the chemical reaction can occur to deposit complex iron and zinc phosphate crystals.

Iron phosphate is most conveniently applied to ferrous substrates, but zinc phosphate is more suitable as a primer coat. Phosphate coatings alone do not provide appreciable corrosion protection, but are useful mainly as a base for paints, ensuring good adherence and decreasing the tendency for corrosion to undercut the paint film at scratches or other defects. Phosphate coatings may also be impregnated with oils or waxes that provide a degree of protection against rusting, especially if corrosion inhibitors are also employed.

Chromate reactions are similar, utilizing chromium in the trivalent and hexavalent states. Chromate conversion coatings are produced on zinc by immersing the cleaned metal for a few seconds on sodium dichromate solution, acidified with sulfuric acid at room temperature, followed by rinsing and drying. A zinc chromate surface increases the life of zinc to a modest degree on exposure to the atmosphere. Despite the effectiveness of chromates in stopping the rusting of ferrous substrates in aqueous solutions, no successful chromate film process has been developed for this purpose. However, the corrosion resistance of a phosphate coating is enhanced by a dip or rinse in an acid chromate solution.

Acmite ($NaFeSi_2O_6$) is a rock-forming mineral of the pyroxene group. It occurs primarily as a product of late crystallization of alkaline magmas. Acmite is very stable under hydrothermal conditions, even at high temperature and pressure, making it an ideal passivation layer candidate. Furthermore, the chemical agents used to prepare acmite coatings do not pollute the environment.

Mild steel is used to line the inner walls of quartz reactors because of the acmite passivation layers that form under the conditions typically employed in a quartz reactor. Bailey, *Amer, J. Sci.,* 267a, 1–16, (1969), reports that acmite is stable over the temperature range of 550–850° C. and pressure range of 20–500 MPa. Reaction kinetics therefore could be a factor influencing the minimum temperature to obtain a reaction product. In many cases, dissolution of an oxide is considered to be the rate-determining step for a hydrothermal reaction. See Eckert et al., *J.Am.Ceram.Soc.,* 79(11) 2929–39 (1996)and Rossetti, et al., *J. Crystal Growth,* 116, 251–259 (1992). Laine et al., *Nature,* 353, 642–644 (1991) have shown that the use of glycols can dissolve otherwise poorly soluble oxides at temperatures as low as 198° C. at atmospheric pressure.

SUMMARY OF THE INVENTION

It has now been discovered that exceptional passivation coatings may be formed on ferrous substrates by heating the substrates in an aqueous basic metal hydroxide treatment bath containing $SiO_2$. It has further been discovered that the addition of a water-soluble glycol to the treatment bath lowers the temperature and pressure threshold for the formation of the passivation coating.

Therefore, according to one aspect of the present invention, a method is provided for forming a passivation coating on a ferrous substrate by heating the ferrous substrate in an aqueous 1.0 to 6.0 M basic metal hydroxide treatment bath containing $SiO_2$ and a water-soluble glycol, at a temperature effective to form a passivation coating on the substrate until a passivation coating forms thereon, wherein the treatment bath contains from about 0.25 to about 1.0 moles of $SiO_2$ per liter of glycol and water.

The treatment bath may be an aqueous $SiO_2$ slurry. Water-soluble forms of silica may be employed as well.

Mild steel may be employed as the ferrous substrate. Basic metal hydroxides include alkali metal and alkaline earth metal hydroxides. When an alkali metal hydroxide is used, such as NaOH or KOH, temperatures as low as 160° C. may be employed. When the LiOH is used, temperatures as low as 220° C. may be employed. The preferred glycol is 1,4-butane diol.

The method of the present invention may be employed to form corrosion-resistant surfaces on ferrous substrates. Workpieces such as brake rotors may be rendered corrosion-resistant by immersing the workpiece in heated treatment baths according to the method of the present invention. Therefore, the present invention also includes corrosion-resistant ferrous workpieces coated with the acmite coatings of the present invention.

The process of the present invention is particularly advantageous because the reactants employed to form the passivation coatings, such as alkali metal hydroxides, alkaline earth metal hydroxides and silica are cheap and abundant and do not pollute the environment. It is possible to vary the processing conditions to obtain microstructural control of the passivation coating on the ferrous substrate. Other features of the present invention will be pointed out in the following description and claims, which disclose the principles of the invention and the best modes which are presently contemplated for carrying them out.

DETAILED DESCRIPTION OF THE PREFERRED EMBODIMENT

Corrosion-resistant ceramic coatings on ferrous substrates are prepared according to the present invention by treating the substrates in an aqueous basic metal hydroxide and glycol solution containing silica at temperatures between 160° and 260° C. Deionized water is preferred. The process is particularly effective in forming corrosion-resistant coatings on mild steel substrates.

Essentially, any water-soluble glycol may be employed. Preferred glycols are ethylene glycol and 1,4-butanediol. 1,4-Butanediol is most preferred. The quantity of glycol employed should be an amount effective to provide a ratio of glycol to water between about 0.25:1 and 1:0 and preferably the ratio is between about 0.25:1 and about 1:1.

Between about 1.0 and about 6.0 moles of basic metal hydroxide per mole of $SiO_2$ should be used, with about 1.0 and about 2.0 moles being preferred. For example, the treatment bath may be prepared from a solution of one mole of silica per liter of aqueous 1.0 to 6.0 M basic metal hydroxide, with the use of aqueous 1.0 to 2.0 M basic metal hydroxides being preferred.

Basic metal hydroxides include alkali metal and alkaline earth metal hydroxides, with alkali metal hydroxides being preferred. NaOH, KOH and LiOH are more preferred, with NaOH and KOH being most preferred.

When NaOH or KOH is used, a reaction temperature between about 160° and 240° C. may be employed, with a reaction temperature about between 200° and about 240° C. being preferred. When LiOH is used, a reaction temperature between about 240° and 260° C. may be employed.

Between about 0.25 and about 1.0 moles per liter of silica is added to the mixed solution of water and glycol. A quantity of silica between about 0.5 and about 1.0 moles per liter is preferred. As noted above, solutions of water-soluble forms of silica, as well as silica slurries, may be employed.

The ferrous substrate is immersed in the heated reaction mixture until the corrosion-resistant ceramic coating is formed. The reaction may be performed in an open vessel at atmospheric pressure, or within a closed system at autogenous pressure.

Typically, this requires a reaction time of between about six and about ninety-six hours. After treatment, the sealed vessel and its contents should be cooled under ambient conditions, followed by washing of the substrate with water, preferably deionized. Preferably, the substrate is washed by boiling in deionized water. The substrates are then dried.

The aqueous basic metal hydroxide and glycol solution is a very high oxidizing agent. Accordingly, the formation temperature of passivation coatings on ferrous substrates is dramatically reduced.

Corrosion-resistant surfaces may be formed on ferrous workpieces such as brake rotors by heating the workpiece in the treatment bath of the present invention until a passivation layer forms. Alternatively, ferrous substrates such as boilers may be treated by adding the treatment bath of the present invention to a boiler and then heating the boiler until a passivation layer forms on the inner walls of the boiler.

The following non-limiting examples set forth hereinbelow illustrate certain aspects of the present invention. They are not to be considered limiting as to the scope and nature of the present invention. In the examples which follow, all parts are by weight. Temperatures are expressed in degrees Celsius.

EXAMPLES

Corrosion-resistant ceramic coatings on steel substrates were prepared by treating steel coupons in a mixed solution of deionized water (10 MΩ.cm, Millipore Corp., Bedford, Mass.) and glycol solvents at temperatures between 160° to 260° C. under autogenous pressure. Reaction conditions such as reaction temperature, reaction time, amount of glycol, type of mineralizer and silica concentration were varied as listed in Tables 1 and 3–5. Steel coupons (Metaspec Co. San Antonio, Tex.) with dimensions of 2"×2"×1/16" were degreased with electronic grade acetone (Fisher Scientific, Fairlawn, N.J.) with an ultrasonic cleaner (Fisher Scientific).

To examine the effects of different glycols, ethylene glycol and 1,4-butane diol (Aldrich Chemical Co., Inc., Milwaukee, Wis.) were employed. The volume ratio of water to glycol was varied between 0:70 and 70:0 to find the optimum amount of aqueous glycol solution with a total volume of 70 ml. Quartz powders (75 μm) (U.S. Silica, Berkeley Springs, W.Va.) were added to the reaction media as a silica source. Assuming that the quartz powder and mineralizers were completely dissolved in 70 ml solvent, the molarity (M) was expressed as the ratio of moles of solute per liters of glycol and water. The molar concentration of silica was changed from 0.25 to 1 M to find the optimum amount of silica for formation of a ceramic coating. It was observed that quartz powders were dissolved more in a mixed solvent when the amount of water was increased from 15 mL to 55 mL. KOH, NaOH and LiOH (Fisher Scientific) were used to determine the effects of different basic metal hydroxides. Relative to dissolved silica, the molar concentration was varied from 1 to 6 M.

The steel coupon was suspended by a Teflon wire in a 125 mL Teflon-lined autoclave filled with a slurry of water, glycol, silica and basic metal hydroxides. The vessel was then sealed and heated to the desired temperature at the heating rate of 1° C./min in a gravity convection oven (Fisher Scientific, Isotemp Model 218A). The reaction time at the desired temperature was varied at between 6 and 96 h.

To examine the effect of polishing, a steel coupon was polished into mirror image with #1200 SiC Paper (Buehler, Lake Bluff, Ill.).

After hydrothermal treatment, the vessel was cooled to about 50° C. under ambient conditions. The steel coupons were washed by boiling in deionized water. After washing, the recovered samples were dried at 25° C. in desiccator for 48 h. Crystalline phases were determined using X-ray diffraction. The analyses were performed on a Siemen's D500 diffractometer (Siemens Analytical X-Ray Instruments, Inc., Madison, Wis.) using Ni-filtered CuK alpha radiation, monochrometer, divergent slit of 1°, and receiving slit of 0.05. The data were collected by a DACO microprocessor (Siemens Analytical X-Ray Instruments) using a stepwidth of 0.10° 2Θ and a measuring time of 1 s.

Experimental data from XRD patterns were compared to standards recommended by the Joint Committee on Powder Diffraction and Standards (JCPDS) to determine the chemical identity of the products. The microstructure and grain size of the synthesized ceramic coating was observed using field-emission scanning electron microscopy (FESEM) (LEO Electron Microscopy Ltd., Thornwood, N.Y.). The thickness of ceramic coatings was estimated using the mass increased during the hydrothermal process. It was assumed that there was no dissolution of the coating and that the coating was pure and had its bulk density (acmite=3.6 g/cm$_3$).

Example 1

1,4-butanediol-water system

Reaction Temperature

The effect of temperature (160°–240° C.) on the formation of acmite coatings was studied with 1 M NaOH and 1 M $SiO_2$ in a solution of 15 ml 1,4-butanediol and 55 ml water. A reaction time of 48 h was employed.

TABLE 1

Influence of reaction conditions on the formation of acmite coating on steel substrate in NaOH 1,4-butanediol system

| Sample | Temp. (° C.) | $H_2O$/1,4-Butanediol (ml/ml) | NaOH (M) | $SiO_2$ (M) | Time (h) | Results |
|---|---|---|---|---|---|---|
| BUT-01 | 240 | 0/70 | 2 | 1 | 48 | magnetite |
| BUT-02 | 240 | 15/55 | 2 | 1 | 48 | magnetite |
| BUT-03 | 240 | 35/35 | 2 | 1 | 48 | acmite |
| BUT-04 | 240 | 70/0 | 2 | 1 | 48 | magnetite |
| BUT-05 | 220 | 55/15 | 1 | 1 | 24 | acmite |
| BUT-06 | 220 | 55/15 | 1 | 0.5 | 48 | acmite |
| BUT-07 | 220 | 55/15 | 1 | 1 | 48 | acmite |
| BUT-08 | 220 | 55/15 | 2 | 0 | 48 | magnetite |
| BUT-09 | 220 | 55/15 | 2 | 0.25 | 48 | magnetite |
| BUT-10 | 220 | 55/15 | 2 | 0.5 | 48 | acmite |
| BUT-11 | 220 | 55/15 | 2 | 1 | 24 | acmite |
| BUT-12 | 220 | 55/15 | 2 | 1 | 48 | acmite |
| BUT-13 | 220 | 55/15 | 2 | 1 | 48 | acmite (polished sample) |
| BUT-14 | 220 | 70/00 | 2 | 1 | 48 | magnetite |
| BUT-15 | 200 | 55/15 | 1 | 1 | 48 | acmite |
| BUT-15 | 200 | 55/15 | 2 | 1 | 48 | acmite |

TABLE 1-continued

Influence of reaction conditions on the formation of acmite coating on steel substrate in NaOH 1,4-butanediol system

| Sample | Temp. (° C.) | $H_2O$/1,4-Butanediol (ml/ml) | NaOH (M) | $SiO_2$ (M) | Time (h) | Results |
|---|---|---|---|---|---|---|
| BUT-17 | 180 | 55/15 | 1 | 1 | 48 | acmite |
| BUT-18 | 150 | 55/15 | 1 | 1 | 48 | magnetite |

Reaction temperature had a significant influence on the characteristics of the acmite coatings on these steel coupons. With 1 M NaOH, an acmite coating started to form at temperatures as low as 200° C. The formation temperature of the coating decreased from 200° to 180° C. by increasing the amount of NaOH from 1 to 2 M.

The reaction temperature had a large effect on the morphology and surface coverage of the acmite coating synthesized. The surface coverage of the coating on steel coupon improves with increasing reaction temperature. The size of grains in the microstructure tends to decrease fivefold down to 1–2 μm with increasing the reaction temperature from 180° to 220° C. The grain morphologies are strongly dependent on the reaction temperature varying from a prismatic shape terminated by two faces to an asymmetrical pyramidal shape when the reaction temperature was varied from 180°to 220° C.

Reaction Time

Reaction time played an important role in the phase transformation from magnetite to acmite. Steel coupons immersed in 1 M NaOH and 1 M $SiO_2$ in a blend of 15 mL 1,4-butanediol and 55 ml water at 220° C. started to form, by surface oxidation, a coating of magnetite ($Fe_3O_4$) at a reaction time of 6 h. The reaction between magnetite and silica species in the NaOH solution promoted the formation of acmite on steel with a grain size of about 0.5 to about 1 μm at a reaction time of 12 h or greater. The grain size grew to 3–5 μm with increased reaction time after 12 h. At a reaction time of 24 h, small (0.5–1 μm) and large (3–5 μm) grains of acmite coexist. At 48 h, the steel coupon was completely covered with large grains of acmite.

Higher ratios of 1,4-butanediol to water retarded the formation of acmite by a factor of 2. When a 1:1 solution of 1,4-butanediol and water was used, a good, porous magnetite coating was observed after a reaction time of 24 h. At a reaction time of 48 h or greater, an acmite coating having a grain size of 20–30 μm completely covered the steel surface. Thus, the surface coverage and grain size of an acmite coating can be controlled by changing the reaction time and the ratio of 1,4-butanediol to water.

1,4-Butanediol—Water Ratio

At 240° C., with 2 M NaOH and 1 M $SiO_2$, and 48 h reaction time, magnetite coatings form when 55/25 and 70/0 mL 1,4-butanediol/water solutions were used. Poor surface coverage was evident. In pure water with all other conditions equal, low crystalinity magnetite coatings with poor surface coverage resulted. However, acmites with good surface coverage were obtained when solutions of 15/55 and 35/35 mL 1,4-butanediol/ water were employed.

Silica Concentration

At 220° C. and 48 h reaction time, silica concentration in a solution of 15/55 mL 1,4-butanediol/water was varied from 0.25 to 1 M. The grain size of acmite tended to decrease with increasing silica concentration. In the case of 1 M NaOH, the grain size decreased from 4–5 to 2–3 μm when the silica concentration increased from 0.5 to 1 M.

In the case of 2 M NaOH, the effect of silica concentration on grain size was more evident. The grain size decreased from 5–10 to 3–5 μm when the silica concentration increased from 0.5 to 1 M. A dense coating having good surface coverage on the steel substrate was obtained when maximum silica concentration was used. Acmite did not form below a silica concentration of 0.5 M. Table 2 depicts the average thickness estimated from the weight gain of the steel substrate for an acmite coating grown at 220° C. with a reaction time of 48 h in a 2 M NaOH and 1 M $SiO_2$ 15/55 mL 1,4-butane-diol/water solution. The average thickness, 7.65 μm, was calculated for one side of the steel coupon, assuming that the steel coupon was uniformly coated on both sides.

TABLE 2

Weight Gain of Acmite Coating

| Sample ID | Sample No. | Start (g) | Finish (g) | Weight Gain (g) | Thickness (μm) |
|---|---|---|---|---|---|
| BUT-12 | 1 | 7.7498 | 7.7810 | 0.0312 | 6.72 |
| | 2 | 7.7257 | 7.7610 | 0.0353 | 7.60 |
| | 3 | 7.7325 | 7.7742 | 0.0417 | 8.98 |
| | 4 | 7.6213 | 7.6552 | 0.0339 | 7.30 |

Polishing

At 220° C. with a reaction time of 48 h, in a 2 M NaOH and 1 M $SiO_2$, 15/55 mL, 1,4-butanediol/water solution, dense acmite (3–5 μm) with good surface coverage is formed on steel coupons used as received, whereas 30–50 μm sized acmite crystals were scattered on a polished steel surface. Thus, polishing does not promote complete acmite surface coverage.

Example 2

Ethylene glycol-Water System

Ethylene-glycol vs. 1,4-butanediol

Ethylene glycol was also effective for promoting formation of inorganic coatings on steel substrates. Unlike the 1,4-butanediol/water system, at otherwise identical synthesis conditions (200° C., 48 hours, 15/55 mL glycol/water), magnetite coatings form instead of acmite coatings in ethylene glycol/water solutions. This is attributable to the difference in oxidation strength and silica-complex formation between 1,4-butanediol and ethylene glycol. However, at higher reaction temperature (220° C.) uniform and fine grain (3–5 μm) acmite coatings were produced in both 1,4-butanediol/water and ethylene glycol/water systems. The morphology of the coating varied from prismatic shaped terminated by 2 faces to the asymmetrical pyramid shape when the solvent changed from ethylene glycol to 1,4-butanediol.

TABLE 3

Influence of reaction conditions on the formation of acmite coating on steel substrate in NaOH-ethylene glycol system.

| Sample | Temp. (° C.) | $H_2O$/Ethylene Glycol (ml/ml) | NaOH (M) | $SiO_2$ (M) | Time (h) | Results |
|---|---|---|---|---|---|---|
| EGL-01 | 240 | 55/15 | 2 | 0.25 | 48 | magnetite |
| EGL-02 | 240 | 55/15 | 2 | 0.5 | 48 | acmite |
| EGL-03 | 240 | 55/15 | 2 | 1 | 48 | acmite |
| EGL-04 | 220 | 00/70 | 2 | 1 | 48 | magnetite |
| EGL-05 | 220 | 35/35 | 2 | 1 | 48 | acmite |

TABLE 3-continued

Influence of reaction conditions on the formation of acmite coating on steel substrate in NaOH-ethylene glycol system.

| Sample | Temp. (° C.) | $H_2O$/Ethylene Glycol (ml/ml) | NaOH (M) | $SiO_2$ (M) | Time (h) | Results |
|---|---|---|---|---|---|---|
| EGL-06 | 220 | 55/15 | 2 | 1 | 48 | acmite |
| EGL-07 | 200 | 55/15 | 1 | 1 | 48 | magnetite |
| EGL-08 | 200 | 55/15 | 2 | 1 | 48 | magnetite |
| EGL-09 | 180 | 55/15 | 2 | 1 | 48 | magnetite |

Reaction Temperature

The effect of temperature (160°–240° C.) was studied in 2 M NaOH 15/55 mL ethylene glycol/water solution at a reaction time of 48 hours. Acmite coatings started to form at temperatures as low as 220° C. The reaction temperature also had a large effect on the morphology and surface coverage of the ceramic coating synthesized. The morphology varied from plate-like shape (magnetite) to prismatic shape (acmite) terminated by 2 faces when the reaction temperature increased from 200° to 220° C. Increasing the reaction temperature from 220° to 240° C. promotes a more distinct, elongated prismatic shape terminated by two faces. The surface coverage of the coating on steel coupons improved with increasing reaction temperature. The grain size of the coating increased from 5–10 to 10–20 μm with increasing reaction temperature from 220° to 240° C. Average thickness estimates from the weight gain of the steel substrate is about 4.3 μm for acmite coatings grown at 240° C. for 48 h in 2 M NaOH and 1 M $SiO_2$ 15/55 ml ethylene glycol/water solutions.

Example 3

Alkali Metal Hydroxides

The effect of various alkali metal hydroxides was studied for 1 M $SiO_2$ 15/55 mL 1,4-butanediol solutions at a reaction time of 48 h. The hydroxides used in the reaction had a great effect on the formation of a ceramic coating on steel substrates. Three different types of ceramic coatings were prepared by using NaOH, KOH and LiOH. A potassium iron silicate hydrate coating $(KFe_3)(FeSi_3)O_{10}(OH_2)$ was obtained when KOH was used, whereas a lithium iron oxide coating ($\alpha$-$LiFe_5O_8$) was obtained when LiOH was used. The morphology of the coating varied from cylindrical shaped to the asymmetrical pyramid shape with face modifications for KOH and LiOH, respectively. This suggests that is it possible to make ceramic coatings with different compositions and morphologies by changing the basic metal hydroxides employed in the reaction.

TABLE 4

Influence of reaction conditions on the formation of ceramic coating on steel substrate in KOH-1,4-butanediol system.

| Sample | Temp. (° C.) | $H_2O$/1,4-Butanediol (ml/ml) | KOH (M) | $SiO_2$ (M) | Time (h) | Results |
|---|---|---|---|---|---|---|
| BUKO-01 | 240 | 55/15 | 3 | 1 | 12 | potassium iron silicate hydroxide |
| BUKO-02 | 220 | 55/15 | 1 | 1 | 48 | potassium iron silicate hydroxide |
| BUKO-03 | 220 | 55/15 | 2 | 1 | 48 | potassium iron silicate hydroxide |

TABLE 4-continued

Influence of reaction conditions on the formation of ceramic coating on steel substrate in KOH-1,4-butanediol system.

| Sample | Temp. (° C.) | $H_2O$/1,4-Butanediol (ml/ml) | KOH (M) | $SiO_2$ (M) | Time (h) | Results |
|---|---|---|---|---|---|---|
| BUKO-04 | 220 | 55/15 | 3 | 1 | 12 | potassium iron silicate hydroxide |
| BUKO-05 | 200 | 55/15 | 1 | 1 | 12 | potassium iron silicate hydroxide |
| BUKO-06 | 200 | 55/15 | 2 | 1 | 12 | potassium iron silicate hydroxide |
| BUKO-07 | 200 | 55/15 | 3 | 1 | 12 | potassium iron silicate hydroxide |
| BUKO-08 | 200 | 55/15 | 4 | 1 | 12 | potassium iron silicate hydroxide |
| BUKO-09 | 200 | 55/15 | 5 | 1 | 12 | potassium iron silicate hydroxide |
| BUKO-10 | 200 | 55/15 | 6 | 1 | 12 | potassium iron silicate hydroxide |
| BUKO-11 | 180 | 55/15 | 3 | 1 | 12 | potassium iron silicate hydroxide |
| BUKO-12 | 160 | 55/15 | 3 | 1 | 12 | potassium iron silicate hydroxide |

Reaction Temperature in KOH-1,4-butanediol System

The effect of temperature (160°–240° C.) was studied for a 1 M $SiO_2$ 15/55 mL 1,4-butanediol/water solution at a reaction time of 48 h. Potassium iron silicate hydrate coatings started to form at temperatures as low as 160° C. Reaction temperature also had an effect on the surface coverage and grain size of the coating synthesized. The surface coverage of the coating on steel coupons improved with increasing reaction temperature. The coating did not completely cover the steel surface at reaction temperatures lower than 200° C. The grain size of the coating tended to increase from 1 to 5 $\mu$m with increasing reaction temperature. The grains of the coating had a more distinct hexagonal platelet shape as reaction temperature increased.

KOH Concentration

Increasing the amount of KOH reduced reaction time and promoted formation of potassium iron silicate hydrate coatings on steel coupons. For 1 M $SiO_2$ 15/55 ml 1,4-butanediol/water solutions at 200° C., the reaction on steel surfaces was sluggish at 1 M KOH. Potassium iron silicate hydrate formed did not completely cover steel surfaces even at a reaction time of 48 h, whereas potassium iron silicate hydrate coatings completely covered steel surfaces at a reaction time of 6 h when more than 3 M KOH was added.

The morphology of potassium iron silicate hydrate coatings was related closely to the mineralizer concentrations employed. The grain size of the coating tended to increase from 0.5–1 to 3–4 $\mu$m as the KOH concentration increased from 1 to 4 M. The morphology of the coating varied from cylindrical shape to hexagonal platelet shape as the concentration of KOH increased from 1 to 4 M. The aspect ratio of the coating grain increased from 1 to 5 as the concentration of KOH increased from 1 to 4 M.

The results indicate that it is possible to prepare ceramic coatings on steel substrates at temperatures as low as 160° C. with dramatically reduced reaction times at high concentrations of KOH. This result may lead to opportunities to make the ceramic coatings and reaction vessels at atmospheric pressure as opposed to closed systems.

LiOH Concentration in LiOH-1,4-butanediol Systems

Two different types of lithium-based ceramic coatings were prepared with 240° C. solutions 1 M $SiO_2$ in 35/35 mL 1,4-butanediol/water at a reaction time of 48 h. $\alpha$-$LiFe_5O_8$ were obtained at 4 M LiOH whereas $\alpha$-$LiFeO_2$ coatings were obtained at 2 M LiOH.

TABLE 5

Influence of reaction conditions on the formation of ceramic coating on steel substrate in LiOH-1,4-butanediol system.

| Sample | Temp (° C.) | $H_2O$/1,4-Butanediol (ml/ml) | LiOH (M) | $SiO_2$ (M) | Time (h) | Results |
|---|---|---|---|---|---|---|
| BULI-01 | 240 | 35/35 | 2 | 1 | 48 | $\alpha$-$LiFeO_2$ |
| BULI-02 | 240 | 35/35 | 4 | 1 | 48 | $\alpha$-$Li_5FeO_8$ |
| BULI-03 | 220 | 55/15 | 1 | 1 | 48 | $\alpha$-$Li_5FeO_8$ |

This data suggests that the solubility of silica is insufficient for acmite formation in LiOH-1,4-butanediol systems.

As will now be readily appreciated, the present invention provides a method for preparing ceramic coatings on steel in which the coating characteristics such as grain size, coating thickness and degree of coverage can be controlled by changing process variables such as glycol type, basic metal hydroxide, quartz concentration, reaction temperature, reaction time, glycol-water ratio, and hydroxide concentration.

The foregoing description of the preferred embodiment should be taken as illustrating, rather than as limiting, the present invention as defined by the claims. Numerous variations and combinations of the features described above can be utilized without departing from the present invention.

What is claimed is:

1. A method for forming a passivation coating on a ferrous substrate, comprising heating said ferrous substrate in an aqueous treatment bath comprising a basic metal hydroxide, $SiO_2$, and a water-soluble glycol, at a temperature above about 160° C. so that said basic metal hydroxide and said water-soluble glycol in said treatment bath oxidize said ferrous substrate, whereby said passivation coating is formed thereon at a temperature less than the temperature at which said passivation coating forms in the absence of said water soluble glycol, wherein said treatment bath comprises from about 0.25 to about 1.0 mole of $SiO_2$ per liter of glycol and water.

2. The method of claim 1, wherein said substrate is heated in a sealed vessel at autogenous pressure.

3. The method of claim 1, wherein said treatment bath comprises a slurry of silica in said aqueous basic metal hydroxide.

4. The method of claim 1, wherein said treatment bath comprises a solution of silica in said aqueous basic metal hydroxide.

5. The method of claim 1, wherein said bath temperature is less than 260° C.

6. The method of claim 5, wherein said basic metal hydroxide is NaOH or KOH and said bath temperature is between 200 and 240° C.

7. The method of claim 1, wherein said glycol is 1,4-butanediol or ethylene glycol.

8. The method of claim 1, wherein the ratio of glycol to water is between 0.25:1 and 1:1.

9. The method of claim 1, wherein said basic metal hydroxide is LiOH and said bath temperature is between 220° and 240° C.

10. The method of claim 1, wherein said basic metal hydroxide is KOH or NaOH and said bath temperature is between 160° and 240° C.

11. The method of claim 10, wherein said bath temperature is between 180°and 200° C.

12. The method of claim 10, wherein said basic metal hydroxide is NaOH, and said glycol, $SiO_2$ concentration, NaOH concentration, glycol concentration and reaction time are effective to form an acmite coating on said ferrous substrate.

13. The method of claim 1, wherein said basic metal hydroxide is NaOH, and said glycol, NaOH concentration, $SiO_2$ concentration, glycol concentration and reaction time are effective to form an acmite coating on said ferrous substrate.

14. A method for forming a passivation coating on a ferrous substrate, comprising heating said ferrous substrate in an aqueous 1.0 to 6.0 M basic metal hydroxide treatment bath comprising the basic metal hydroxide, $SiO_2$, and a water-soluble glycol, at a temperature above about 160° C. so that said basic metal hydroxide and said water-soluble glycol in said treatment bath oxidize said ferrous substrate, whereby said passivation coating is formed thereon at a temperature less than the temperature at which said passivation coating forms in the absence of said water soluble glycol, wherein said treatment bath comprises from about 0.25 to about 1.0 mole of $SiO_2$ per liter of glycol and water.

15. The method of claim 14, wherein said basic metal hydroxide is NaOH, and said glycol, NaOH concentration, $SiO_2$ concentration, glycol concentration and reaction time are effective to form an acmite passivation coating on the surface of said workpiece.

16. A method for forming a passivation coating on a ferrous substrate, comprising heating said ferrous substrate in an aqueous treatment bath comprising a basic metal hydroxide, $SiO_2$, and 1,4-butanediol or ethylene glycol, at a temperature that is effective to form a passivation coating on said substrate until said passivation coating is formed thereon, wherein said treatment bath comprises from about 0.25 to about 1.0 mole of $SiO_2$ per liter of 1,4-butanediol or ethylene glycol.

17. The method of claim 16, wherein said treatment bath comprises 1,4-butanediol.

18. The method of claim 16, wherein said treatment bath comprises ethylene glycol.

19. The method of claim 16, wherein said substrate is heated in a sealed vessel at autogenous pressure.

20. The method of claim 16, wherein said bath temperature is less than 260° C.

* * * * *

UNITED STATES PATENT AND TRADEMARK OFFICE

CERTIFICATE OF CORRECTION

PATENT NO. : 6,159,552
DATED : December 12, 2000
INVENTOR(S) : Richard E. Riman and Seung-Beom Cho It is certified that error appears in the above-identified patent and that said Letters Patent is hereby corrected as shown below:

Column 11,
Lines 9 to 20, should read

14. A method of forming a passivation coating on a ferrous workpiece comprising heating a workpiece in an aqueous 1.0 to 6.0 M basic metal hydroxide treatment bath comprising the basic metal hydroxide, $SiO_2$ and a water-soluble glycol at a temperature above about 160° C so that said basic metal hydroxide and said water-soluble glycol in said treatment bath oxidize said ferrous substrate, whereby said passivation coating is formed thereon at a temperature less than the temperature at which said passivation coating forms in the absence of said water-soluble glycol, wherein said treatment bath comprises from about 0.25 to about 1.0 moles of $SiO_2$ per liter of glycol and water.

Signed and Sealed this

Thirtieth Day of April, 2002

*Attest:*

*Attesting Officer*

JAMES E. ROGAN
*Director of the United States Patent and Trademark Office*